United States Patent [19]

Towsend

[11] 4,346,928

[45] Aug. 31, 1982

[54] SNOW PLOW ATTACHMENT

[76] Inventor: Marvin S. Towsend, 1365 Potomac Heights Dr., Oxon Hill, Md. 20022

[21] Appl. No.: 22,169

[22] Filed: Mar. 20, 1979

Related U.S. Application Data

[63] Continuation-in-part of Ser. No. 874,816, Feb. 3, 1978, Pat. No. 4,153,287.

[51] Int. Cl.[3] ..... E01H 5/12

[52] U.S. Cl. ..... 294/51; 37/207; 37/232

[58] Field of Search ..... 294/51, 54; 37/53, 42 R, 37/44, 46, 29, DIG. 3, 50; 30/169, 208; 15/111

[56] References Cited

U.S. PATENT DOCUMENTS

| | | | |
|---|---|---|---|
| 287,583 | 10/1883 | Royal | 37/29 |
| 634,578 | 10/1899 | Kaucher | 37/53 |
| 634,963 | 10/1899 | Smith | 37/53 |

*Primary Examiner*—James B. Marbert

[57] ABSTRACT

A bristle support, having semirigid long lasting bristles, is attached to a snow plow near the lower cutting edge of the plow blade so that the semirigid bristles project below the blade edge and serve the multiple functions of: rigidly contacting the surface to be cleared thereby providing a cutting action on the undesired material on the surface to be cleared and a brushing of the surface; and at the same time having the flexibility to yield to and ride over small surface irregularities and resiliently return to normal position when the irregularities are passed.

4 Claims, 4 Drawing Figures

SNOW PLOW ATTACHMENT

CROSS REFERENCE TO RELATED APPLICATION

This application is a continuation-in-part of pending application Ser. No. 874,816 filed Feb. 3, 1978 now U.S. Pat. No. 4,153,287 issued May 8, 1979.

FIELD OF THE INVENTION

The invention relates to snow plows and the like which have means associated with the lower cutting edge of the plow blade for scraping the road surface.

BACKGROUND OF THE INVENTION

In the art of snowplows which are used for clearing roadways and the like, considerable effort has been directed toward designing snowplow devices which are aimed at solving a pervasive problem; namely, clearing as much snow and slush as possible from the roadway while at the same time not damaging the road surface and not allowing irregularities in the road surface to damage the snowplow device.

Several different approaches have been tried. In one approach, a motor vehicle is provided with two separate and distinct means for removing snow and slush. Snow is removed by a scraper blade positioned somewhat above the road surface providing a clearance between the blade and the road. Slush is removed by a motor powered rotary brush whose bristles are disposed radially around a central, rotating axis, and which contact the road surface tangentially. This dual approach is complex and expensive requiring a separate scraper and separate motorized rotary brush.

In a second approach to solve the problem, a resilient, relatively soft rubber strip is attached to the lower edge of a plow blade. This strip contacts the road surface, scraping it and resiliently yielding to surface irregularities. Both snow and slush are removed simultaneously. The relatively soft rubber, however, is in constant contact with the road surface, at relatively high speed, and undergoes rapid wear and must be replaced often.

In a third approach, the entire plow blade, not just the leading edge, responds to surface irregularities. The entire plow blade is pivoted so that its leading edge changes from a sharply acute cutting angle to a broader angle allowing the leading edge to ride over an obstruction in the roadway. When the obstruction is passed, a spring action reorients the entire plow blade so that the leading edge returns to the sharply acute cutting angle. This approach requires a complex support structure for the entire plow blade. Furthermore, it requires a heavy duty spring-loaded device to return the blade to normal position.

Finally, another present approach to solve the problem of maintaining the plow blade in close contact with the road surface while simultaneously yielding to and riding over road surface irregularities is found in a hard plastic strip attached to the leading edge of a plow blade. The hard plastic strip is hard enough to maintain an acute cutting angle of the leading edge under normal circumstances, and it is flexible enough to yield to relatively immovable road surface irregularities, such as manhole covers. However, more easily moved surface irregularities, such as uneven borders between the original road surface and potholes, would be susceptible to plow blade damage because of the relatively acute cutting angle of the hard plastic strip. Another disadvantage of the hard plastic strip is evidenced when the hard plastic strip does yield to an immovable surface irregularity in that the strip does not maintain close contact with the sides of the obstruction. For example, a cylindrical obstruction would cause the hard plastic strip to yield in the geometrical outline of a parabola; it must stretch partially horizontally in order to yield to a vertical obstruction. The open space between the vertical wall of the cylinder and the parabolic outline of the hard plastic strip as it yields to the cylindrical obstruction would allow snow and slush to be missed by the plow blade, and pass under the blade.

In view of the above deficiencies and inadequacies of present snow plow devices, one object of the invention is to provide an attachment for a snow plow which solves the problem of close contact with the road surface while at the same time yielding to and riding over road surface irregularities.

A second object of the invention is to provide a brush attachment for a snow plow which does not require a separate motive source for its operation.

A third object of the invention is to provide a road surface brush that has a hardness greater than a typical road surface and will, therefore, be long-lasting.

A fourth object of the invention is to eliminate the need for a complex support structure for a plow blade which causes the entire plow blade to yield to road surface irregularities in order to broaden the cutting angle.

A fifth object of the invention is to provide a snow plow brush attachment whose bristles readily conform to the outline shape of the surface irregularities thereby preventing snow and slush from passing readily under the blade.

A sixth object of the invention is to provide a road surface contacting brush whose bristles have a hardness greater than ice.

A seventh object of the invention is to provide sharp bristles which assist the snow and slush removal process by cutting and pressure melting ice.

An eighth object of the invention is to provide a device for close contact with a road surface while at the same time pressing and brushing down against surface irregularities rather than scraping and shaving them off.

These and other objects are accomplished by the invention as described below.

SUMMARY OF THE INVENTION

The invention is a snow plow attachment comprised of semirigid bristles affixed to a bristle support which is positioned adjacent to the lower edge of the plow blade. The semirigid bristles of the invention serve plural complementary functions. They have enough rigidity to support that portion of the weight of the plow blade which is not supported by the motor vehicle, and they brush and scrape down the road surface which they contact. Also, they have the flexibility to resiliently ride over road surface irregularities and return to their normal orientation when the irregularities are passed. The plow blade itself may serve as the support for the brush attachment. In this case, the bristle support is attached directly to the plow blade. The bristle support may be attached to the plow blade support, in which case the bristle support and plow blade share a common support.

DETAILED DESCRIPTION OF THE INVENTION

Figure 1:
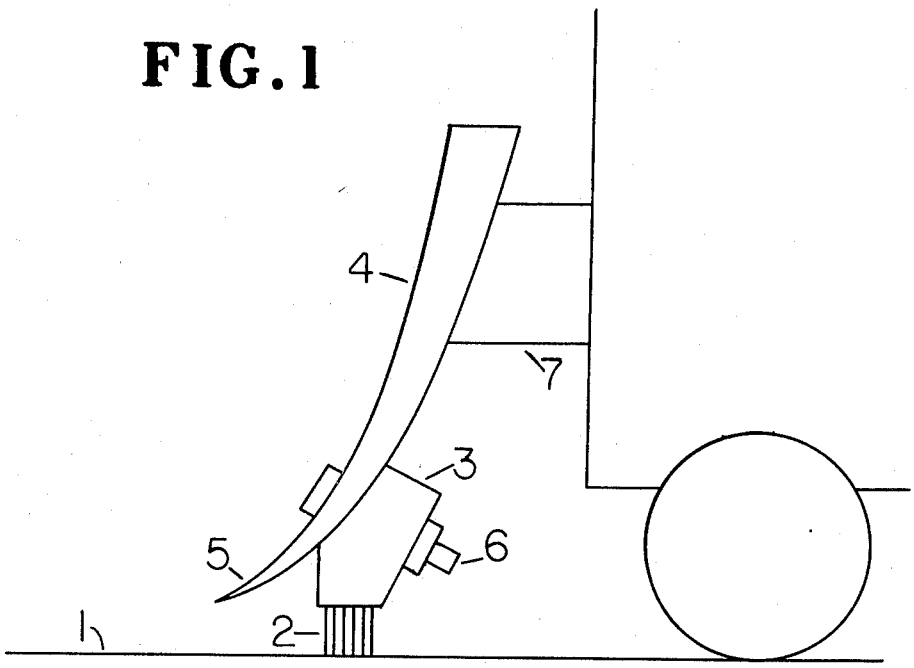
FIG. 1 shows a side view of a bristle support attached directly to a plow blade.

One embodiment of the invention is shown in FIG. 1. Road surface 1 is contacted by semirigid bristles 2 which are supported by bristle support 3 which is connected to plow blade 4 adjacent to leading edge 5 by bolt 6. The plow blade 4 is attached to the motor vehicle by support 7. Holes may be drilled in the plow blade 4 which would align with holes in the bristle support 3 for insertion of connecting bolts 6. Alternatively, the bristle support 3 could be clamped onto plow blade 4 without the necessity of drilling holes in the plow blade. The snow plow attachment of the invention would generally extend the length of the plow blade and would be installed adjacent to the leading edge 5.

Figure 2:
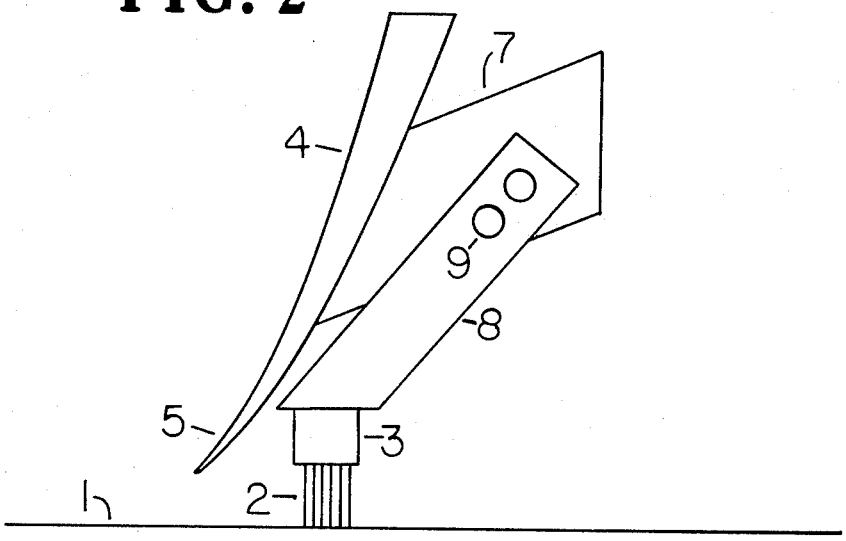
FIG. 2 shows a side view of a bristle support and plow blade sharing a common support.

A second embodiment of the invention is illustrated in FIG. 2. Road surface 1 is contacted by semirigid bristles 2 which are supported by bristle support 3. Bristle support 3 is attached to connecting plate 8 which is attached to plow blade support 7 by means of rivets 9.

Plow blade 4 and bristle support 3 are seen to share common support 7 which is attached to the motor vehicle. The bristle support 3 is installed adjacent to leading edge 5 of the plow blade 4.

Figure 3:
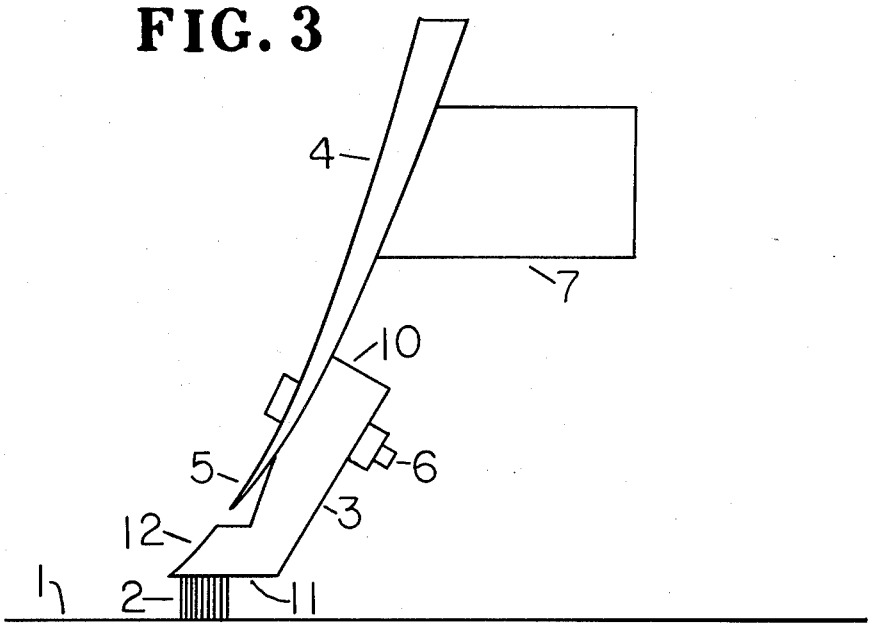
FIG. 3 shows a side view of a bristle support attached directly to a plow blade and having its bristles positioned forward of the leading edge of the plow blade.

A third embodiment of the invention is illustrated in FIG. 3. Bristle support 3 is elongated, having a rearward portion 10 and a forward portion 11. Bolts 6 are used to attach the rearward portion 10 of bristle support 3 to plow blade 4. Forward portion 11 of bristle support 3 is adjacent to leading edge 5 of the plow blade and projects forward of the plow blade. With the semirigid bristles 2 in this position, the snow, ice, and slush are directed upward into plow blade 4. The upper surface 12 of forward position 11 is curved with a radius of curvature similar to the plow blade.

Figure 4:
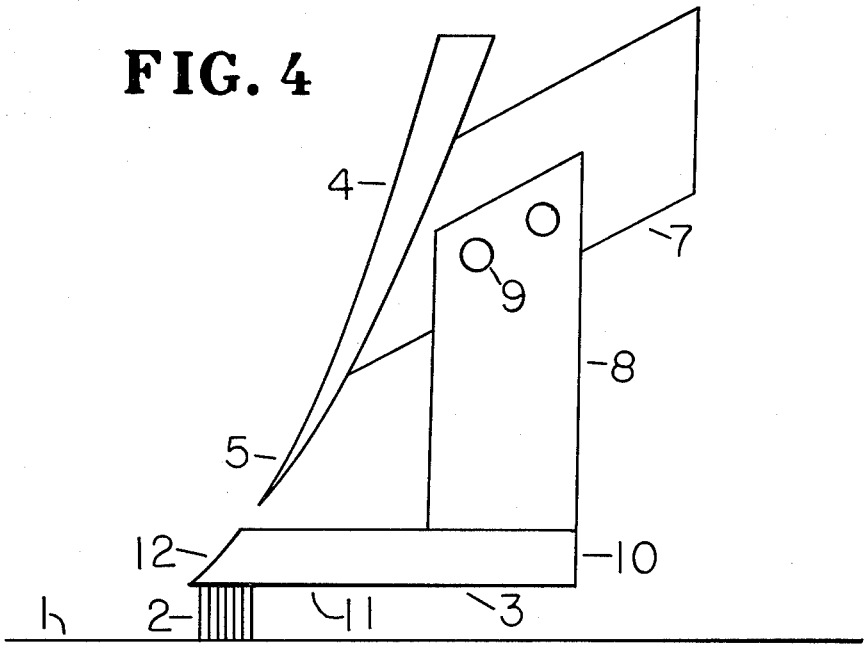
FIG. 4 shows a side view of a bristle support and plow blade sharing a common support and having its bristles positioned forward of the leading edge of the plow blade.

A fourth embodiment of the invention is illustrated in FIG. 4. Bristle support 3 is elongated having rearward portion 10 and forward portion 11. The rearward portion 10 of bristle support 3 is attached to connecting plate 8 which is attached to plow blade support 7 by means of rivets 9. Forward portion 11 of bristle support 3 is adjacent to leading edge 5 of plow blade 4 and projects forward of the plow blade. With the semirigid bristles 2 in this position, snow, ice, and slush are directed upward into plow blade 4. The upper surface 12 of forward portion 11 is curved with a radius of curvature similar to the plow blade.

In the operation of the invention, the bristle support also supports that portion of the weight of plow blade which is not supported by the motor vehicle. As the vehicle moves along the road surface, the bristles press down and brush the road surface. The bristles are semirigid; that is, they are rigid enough to carry a portion of the weight of the plow blade, and they are flexible enough to bend when irregularities in the road surface are encountered. The bristles are also resilient so that after a surface irregularity is passed, the bristles return to their normal orientation. A suitable material for the semirigid bristles is flat wire 0.017 in.×0.059 in.×5 in. made of tempered carbon steel. A suitable bristle holder is a hardwood block. The bristles may be attached to the bristle holder by a variety of methods. One suitable method is to staple the bristles into the hardwood block.

The material of which the bristles are comprised should be selected with due consideration given to bristle durability and long life. One factor affecting the durability is the relative hardness between the bristle material and the material comprising the road surface. The above-mentioned example, tempered carbon steel, satisifies this property in that it has a hardness greater than common road surface materials.

The hardness of the semirigid bristles is greater than that of ice and snow. Therefore, the bristles cut through ice and snow facilitating their removal. The cutting into the ice and snow by the semirigid bristles, has an additional benefit. Just as the metal blade of an ice skate melts a thin layer of ice by pressure thereby providing a thin layer of liquid water which serves as a lubricant, the semirigid bristles of the invention pressure melt some ice and snow thereby providing a thin film of liquid water serving as a lubricant, thereby lowering considerably the frictional resistance that the ice and snow impose upon the inertia of the snow plow.

The effectiveness of the brushing action of the bristles can be affected by changing one or more of three variables; namely, bristle material, bristle density, and bristle length. A high bristle density of coarse bristles which are short results in a more rigid character of the semirigid bristles. A low bristle density of the fine bristles which are long results in a more flexible character of the semirigid bristles. An optimum choice depends on the particular set of factors in question. Regarding a snow plow, factors such as the weight of the plow blade which rests on the bristles, the clearance between the leading edge of the plow blade and the road surface, and the ambient temperature at which the plowing is expected to occur are important.

In choosing bristle materials, both ferrous and nonferrous metals may be used. Hard polymeric material may also be employed.

A heretofore unstated additional advantage of the invention is also realized. Because more snow and slush is removed by the invention than with present devices, less snow and ice is left as a residue on the road surface which will require treatment with salt or abrasives. Therefore, a truckload of salt or abrasives will have a greater area of application than with present devices. Furthermore, by placing less foreign material such as salt or abrasives on the road surface, the road surface, itself, will undergo less deterioration and disintegration than currently occurs. The economic savings in road surface repair would be substantial.

If desired, the bristle support could be adjustably attached to the plow blade or to the plow blade support. Adjustments could be made for lifting the bristles out of contact with the road surface completely, or they could be made to change the angle of attack of the bristles on the road surface. Adjustments could be made manually or by powered means.

What I claim is:

1. In a plow having a plow blade, a plow blade support, and a means for attaching the plow blade to a motor vehicle, the improvement, comprising:

a. a bristle support having semirigid bristles for contacting the surface to be cleared, said bristle support having a forward end with an upper surface and a rearward end, said forward end having its bristles forward of and adjacent to the leading edge of the plow blade thereby directing the moved material which is moved into the plow blade; said semirigid bristles serving the functions of brushing down and scraping down the surface and resiliently yielding to and riding over irregularities on the surface; and b. means for positioning said bristle support adjacent to the leading edge of the plow blade.

2. A snow plow as described in claim 1 wherein the upper surface of said forward end of said bristle support is curved with a radius of curvature similar to that of the plow blade.

3. A plow having a plow blade as described in claim 1 wherein said means for positioning said bristle support adjacent to the leading edge of the plow blade is supported by the plow blade.

4. A plow having a plow blade as described in claim 1 wherein said means for positioning said bristle support adjacent to the leading edge of the plow blade is supported by the plow blade support.

* * * * *